US005844528A

United States Patent [19]

Jones

[11] Patent Number: 5,844,528

[45] Date of Patent: Dec. 1, 1998

[54] SATELLITE FEEDHORN INCLUDING A HEATING ASSEMBLY

[75] Inventor: Thaddeus M. Jones, Bremen, Ind.

[73] Assignee: MSX, Inc., South Bend, Ind.

[21] Appl. No.: 832,527

[22] Filed: Apr. 3, 1997

[51] Int. Cl.[6] ..... H01Q 1/02; H01Q 1/12

[52] U.S. Cl. ..... 343/786; 343/704; 343/872; 343/706; 343/713

[58] Field of Search ..... 343/786, 704, 343/872, 706, 713; H01Q 1/02, 1/12

[56] References Cited

U.S. PATENT DOCUMENTS

| | | | |
|---|---|---|---|
| 486,457 | 9/1989 | Hogg | 343/781 |
| 2,679,003 | 5/1954 | Dyke et al. | 250/33.65 |
| 3,674,215 | 7/1972 | Erdmann | 239/548 |
| 4,195,302 | 3/1980 | Leupelt | 343/704 |
| 4,259,671 | 3/1981 | Levin | 343/704 |
| 4,368,471 | 1/1983 | Walton, Jr. | 343/704 |
| 4,536,765 | 8/1985 | Kaminski | 343/704 |
| 4,866,452 | 9/1989 | Barma et al. | 343/704 |
| 5,010,350 | 4/1991 | Lipkin et al. | 343/704 |
| 5,353,037 | 10/1994 | Jones | 343/704 |
| 5,694,138 | 12/1997 | Crosby | 343/704 |
| 5,729,241 | 3/1998 | Ergen et al. | 343/872 |

FOREIGN PATENT DOCUMENTS

| | | | |
|---|---|---|---|
| 645235 | 10/1950 | European Pat. Off. | 38/40 |
| 57-207402 A | 12/1982 | Japan | H01Q 1/02 |
| 57-208702 A | 12/1982 | Japan | H01Q 1/02 |
| 60-214601 A | 10/1985 | Japan | H01Q 1/02 |
| 1-254003 A | 10/1989 | Japan | H01Q 1/12 |

*Primary Examiner*—Frank G. Font
*Assistant Examiner*—Layla G. Lauchman
*Attorney, Agent, or Firm*—Taylor & Associates, P.C.

[57] ABSTRACT

The invention is directed to a heatable feedhorn assembly including a feedhorn having a wide end and a heater assembly wrapped around the wide end. The heater assembly includes an elongate element in the form of a cable tie and an electrically insulated heater wire wrapped around the elongate element.

20 Claims, 2 Drawing Sheets

SATELLITE FEEDHORN INCLUDING A HEATING ASSEMBLY

BACKGROUND OF THE INVENTION

1. Field of the Invention

The present invention relates to satellite systems, and, more particularly, to feedhorns for use with satellite systems.

2. Description of the Related Art

A feedhorn or "feed" is a device located at the focus point of a parabolic antenna that acts as a receiver or transmitter of radio wave or microwave frequency energy. Transmitted signals and received signals are at different frequencies to prevent interference. When acting as a receiver, the antenna collects, focuses, and couples the radio wave or microwave energy to the feedhorn, which in turn is coupled with transmission lines and an amplifier. Feedhorns are usually located outdoors, where ice or moisture may collect in the receiving end of the feedhorn, attenuating radio or microwave frequency energy entering or exiting the feedhorn.

It is known to pressurize the inside of a feedhorn with dry air and seal it with a mylar window covering the wide end of the feedhorn. The sealed, dry air prevents the formation of ice or liquid water on the inside of the feedhorn. However, a problem with this method is the difficulty in achieving and maintaining the seal. The seal may leak initially, or it may deteriorate with wear and age. Another problem is that dew, frost or ice may still form on the outside of the mylar window, blocking radio or microwave frequency energy from entering the feedhorn. Yet another problem is that liquid water does not quickly evaporate on a cold surface, so water, in addition to ice, may also collect and attenuate energy which enters or exits the feedhorn.

What is needed in the art is a device to prevent or melt ice accumulation on a feedhorn and on the window covering the end of the feedhorn.

SUMMARY OF THE INVENTION

The present invention provides a device for heating a feedhorn to prevent or melt ice accumulation both inside and outside the window covering the end of the feedhorn.

The invention comprises, in one form thereof, a heatable feedhorn assembly including a feedhorn having a wide end and a heater assembly wrapped around the wide end. The heater assembly includes an elongated element in the form of a cable tie and an electrically insulated heater wire wrapped around the elongate element.

An advantage of the present invention is that ice accumulation is prevented or melted both inside and outside the window covering the end of the feedhorn.

Another advantage is that the device is operable in and withstands virtually any range of atmospheric pressure.

Yet another advantage is that the device is adjustable to fit different sizes of feedhorns.

A further advantage is that heating speeds up the evaporation of any water that collects either inside the feedhorn or on the window covering the wide end of the feedhorn.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
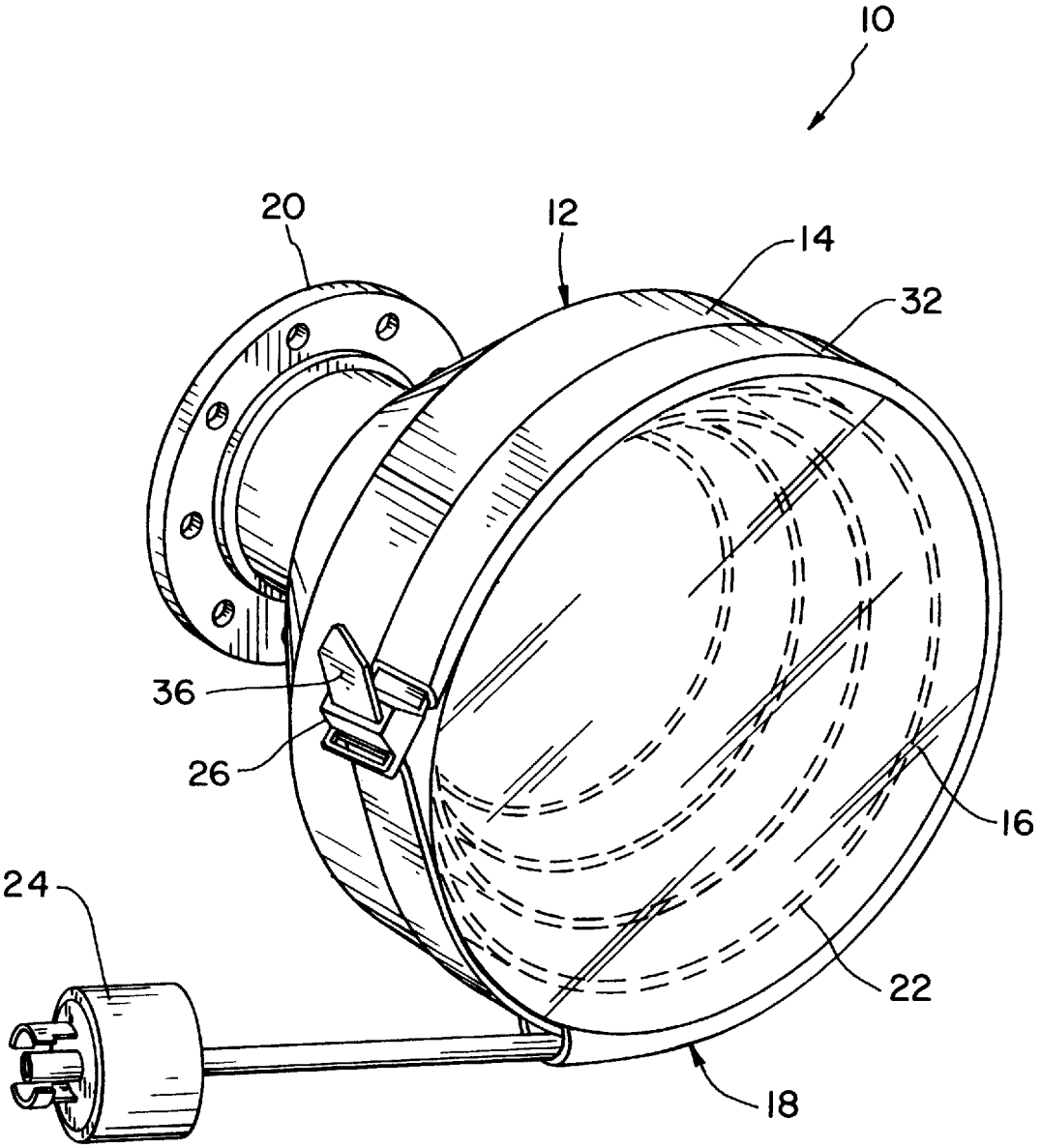
FIG. 1 is a perspective view of one embodiment of a heater assembly of the present invention wrapped around the wide end of a feedhorn.

Referring now to the drawings and particularly to FIG. 1, there is shown a heatable feedhorn assembly 10 including a feedhorn 12 and a heater assembly 18.

Feedhorn 12 includes a signal receiving and transmitting end or wide end 14 and a more narrow second end 20. A translucent Mylar ® window 16 covers wide end 14. Window 16 may be formed from any suitable material allowing the radio frequency waves or microwaves to enter or exit wide end 14 of feedhorn 12. A plurality of concentric ridges 22 are disposed between wide end 14 and narrow end 20 on the inside surface of feedhorn 12. Concentric ridges 22 act as a bandpass filter and help to determine the pattern of the radio or microwave energy. Feedhorn 12 is fabricated from die cast aluminum in the embodiment shown.

Heater assembly 18 (FIGS. 1 and 2) is wrapped around wide end 14 of feedhorn 12. Heater assembly 18 includes an electrically insulated heater wire 30 wrapped around an elongate element such as a cable tie 28. Heater wire 30 includes opposing wire ends 34 which terminate at one end of cable tie 28 and are connected to plug 24 (FIG. 1). Plug 24 interconnects wire ends 34 to an electrical power source (not shown). Heater wire 30 is formed of copper in the embodiment shown, but may be formed from any other suitable material.

Cable tie 28 includes a one-way selectively releasable catch 26 which latches onto opposite end 36 of cable tie 28 to secure cable tie 28 to wide end 14 of feed horn 12 (FIG. 1). Catch 26 may latch onto any part of opposite end 36 not covered by wire 30. Thus, cable tie 28 is adjustable to fit different sized feedhorns 12. Catch 26 includes a resilient tab 27 (FIGS. 1 and 2) which exerts a gripping force on a series of serrations or ribs 29 which run across the width of opposite end 36. Opposite end 36 is inserted into and pushed through catch 26 until the desired tightness around feedhorn 12 is achieved. Tab 27 grips ribs 29 such that opposite end 36 may be pushed through catch 26 to further tighten the hold around feedhorn 12. However, opposite end 36 may not be pulled back through catch 26 unless tab 27 is pushed down away from ribs 29 to disengage opposite end 36. A covering such as a fiberglass cloth 32 is wrapped around wire-wrapped cable tie 28 to hold wire 30 in place and protect wire 30 from physical damage.

Figure 2:
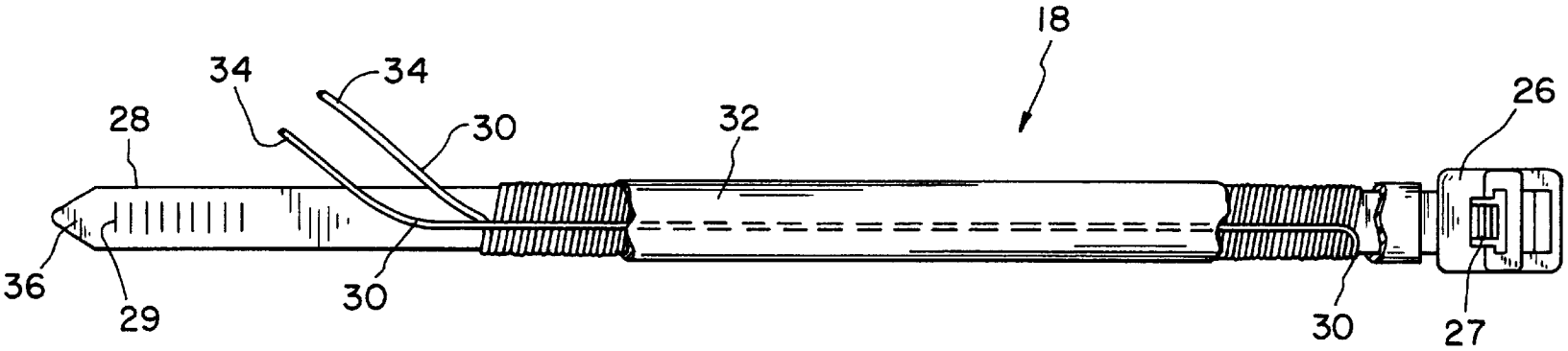
FIG. 2 is a fragmentary top view of the heater assembly shown in FIG. 1.
Figure 3:
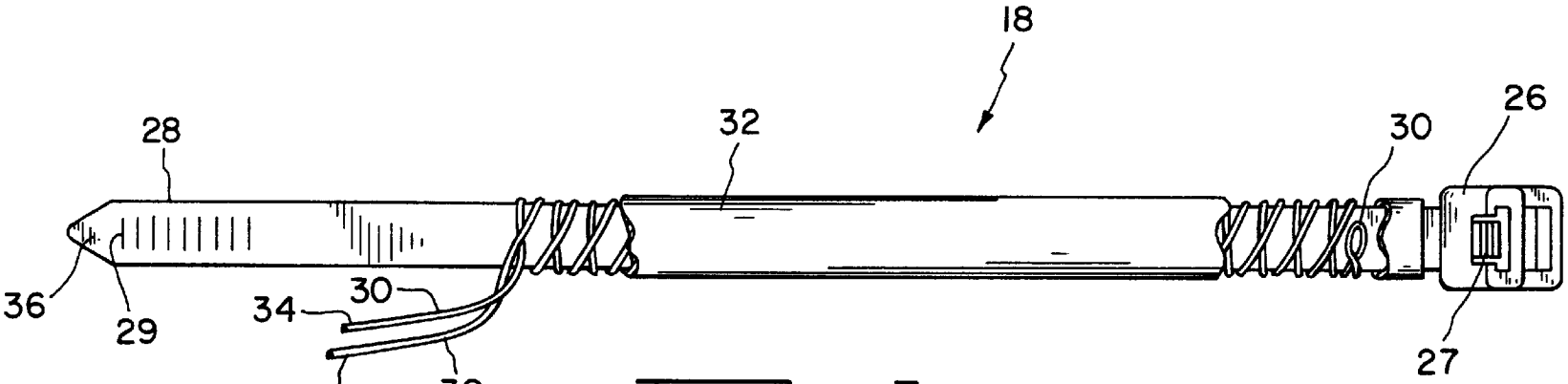
FIG. 3 is a fragmentary top view of another embodiment of a heater assembly of the present invention, wherein the heater wire is folded over in half and twisted before being wrapped around the cable tie.

Wire 30, in the embodiment shown in FIG. 2, is wrapped around cable tie 28 as a helical winding starting at one end of the cable tie and ending at the other. One end of wire 30 then extends back across the wrapped winding such that both ends 34 terminate adjacent to each other for connection with plug 24. However, it is to be understood that wire 30 can be wrapped around cable tie 28 in any of a number of patterns. For example, wire 30 can be wound as a hair pin. That is, wire 30 can be folded over in two equal halves before being wrapped around cable tie 28 (FIG. 3). Current then flows in opposite directions in adjacent halves of wire 30. The magnetic fields from opposite halves of wire 30 tend to cancel each other, virtually eliminating the inductance otherwise created by winding wire 30 in one direction. Inductance reduces the power factor, thus limiting the current available for heating. Opposite halves of wire 30 are twisted around each other in a spiral pattern to further reduce inductance and mechanically link together opposite halves of wire 30.

In use, current flows through heater wire 30, heating wire 30 and, in turn, feedhorn 12. Aluminum, the feedhorn material, is a reasonably efficient conductor of heat. Thus, the temperature of feedhorn 12 remains reasonably uniform even though heater wire 30 does not cover all of wide end 14. Feedhorn 12 can be heated enough to inhibit or melt any ice accumulation on either feedhorn 12 or mylar window 16 under any weather conditions to which feedhorn 12 will be exposed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A feedhorn assembly in a satellite system, said feedhorn assembly comprising:

a feedhorn having an end for at least one of receiving and transmitting a signal; and a heater assembly including an elongate element wrapped around said feedhorn and having opposite ends connected to each other, said heater assembly further including an electrically insulated heater wire wrapped around said elongate element.

2. The feedhorn assembly of claim 1, wherein said elongate element further comprises a one-way selectively releasable catch at one of said ends, said catch latching to an opposite said end of said elongate element.

3. The feedhorn assembly of claim 2, wherein said catch has a tab, said tab configured to allow said opposite end of said elongate element to pass through said catch in only one direction.

4. The feedhorn assembly of claim 3, wherein said tab is configured to disengage said opposite end of said elongate element upon movement of said tab away from said opposite end of said elongate element.

5. The feedhorn assembly of claim 1, wherein said heater wire is comprised of copper.

6. The feedhorn assembly of claim 1, wherein said elongate element is adjustable to fit different sized feedhorns.

7. The feedhorn assembly of claim 1, wherein said heater wire includes opposite ends, and further comprising a plug connected to said heater wire ends.

8. The feedhorn assembly of claim 1, further comprising a covering wrapped around said elongate element and said heater wire.

9. The feedhorn assembly of claim 8, wherein said covering comprises a fiberglass cloth.

10. The feedhorn assembly of claim 1, wherein said elongate element comprises a cable tie.

11. The feedhorn assembly of claim 1, wherein said heater wire is folded over in half, and wrapped around said elongate element.

12. The feedhorn assembly of claim 11, wherein said halves of folded over heater wire are twisted around each other in a spiral pattern.

13. The feedhorn assembly of claim 1, further comprising a window covering said signal receiving and transmitting end of said feedhorn.

14. The feedhorn assembly of claim 13, wherein said window comprises a sheet of mylar.

15. A heater assembly for use with a feedhorn in a satellite system, comprising:

an elongated element sized and configured to be wrapped around the feedhorn and having opposite ends attachable to each other; and an electrically insulated heater wire wrapped around said elongate element and having opposite ends.

16. The heater assembly of claim 15, wherein said elongate element further comprises a one-way selectively releasable catch at one of said ends of said elongate element, said catch latching to an opposite said end of said elongate element.

17. The heater assembly of claim 15, wherein said elongate element is adjustable to fit different sized feedhorns.

18. The heater assembly of claim 15, wherein said elongate element comprises a cable tie.

19. The heater assembly of claim 15, wherein said heater wire is folded over in half and wrapped around said elongate element.

20. The heater assembly of claim 19, wherein said halves of folded over heater wire are twisted around each other in a spiral pattern.

* * * * *

UNITED STATES PATENT AND TRADEMARK OFFICE

CERTIFICATE OF CORRECTION

PATENT NO. : 5,844,528

DATED : Dec. 1, 1998

INVENTOR(S) : Thaddeus M. Jones

It is certified that error appears in the above-identified patent and that said Letters Patent is hereby corrected as shown below:

Title Page, item [54],

Line 2, delete "HEATING" and substitute --HEATER-- therefor.

Column 1

Line 2, delete "HEATING" and substitute --HEATER-- therefor.

Signed and Sealed this

Twenty-fifth Day of May, 1999

*Attest:*

Q. TODD DICKINSON

*Attesting Officer*

*Acting Commissioner of Patents and Trademarks*